United States Patent [19]

Ramos

[11] Patent Number: 4,925,117

[45] Date of Patent: May 15, 1990

[54] BEVERAGE CONTAINER CRUSHER

[76] Inventor: Roy C. Ramos, 2062 W. Merlin Rd., Tucson, Ariz. 85713

[21] Appl. No.: 334,320

[22] Filed: Apr. 7, 1989

[51] Int. Cl.[5] ..... B02C 18/28

[52] U.S. Cl. ..... 241/236; 241/100; 241/190

[58] Field of Search ..... 241/100, 100.5, 292.1, 241/236, 190, 235

[56] References Cited

U.S. PATENT DOCUMENTS

| | | | |
|---|---|---|---|
| 37,510 | 1/1863 | Keeler | 241/236 |
| 1,598,364 | 8/1926 | Cassell . | |
| 1,766,327 | 6/1930 | Bruton . | |
| 3,749,004 | 7/1973 | Pagdin . | |
| 3,835,768 | 9/1974 | Kidson . | |
| 3,926,379 | 12/1975 | Dryden et al. | 241/100 X |
| 4,126,160 | 11/1978 | Gurtler . | |
| 4,195,562 | 4/1980 | Mickler . | |
| 4,459,906 | 7/1984 | Cound . | |
| 4,601,238 | 7/1986 | Davis . | |

FOREIGN PATENT DOCUMENTS

| | | | |
|---|---|---|---|
| 1161238 | 5/1962 | Fed. Rep. of Germany | 241/236 |

*Primary Examiner*—Timothy V. Eley

*Attorney, Agent, or Firm*—J. Michael McClanahan

[57] ABSTRACT

A beverage container crusher adapted to receive for crushing beverage containers holding liquids, the beverage container crusher having an upper feed hopper to receive a plurality of beverage containers, the beverage containers directed to a pair of synchronized, counter-rotating crushing drums. The crushing drums are designed such to initially pierce the beverage container to permit the ready escape of the contained liquids as the beverage container is being crushed between pyramidal shaped crushing teeth, the piercing being accomplished by pyramidal shaped piercing teeth situated on the primary crushing teeth, the primary crushing teeth attached to the crushing drums. A motor and speed reducer drives one of the crusher drums which in turn through a connecting gear, drives the other crushing drums through its connecting gear. The beverage containers are first pierced to relieve the contained liquid and then crushed between the crushing teeth to flatten the containers. Immediately below the crushing drums is a wire mesh basket which receives the crushed containers, the liquid formerly held in the container also passing into the wire mesh basket but escaping through the wire mesh to a collection sump pan immediately below where it is collected and drained off.

9 Claims, 1 Drawing Sheet

BEVERAGE CONTAINER CRUSHER

BACKGROUND OF THE INVENTION

1. Field of the Invention

The field of the invention is devices which receive empty and full beverage containers for crushing in order to make scrap from the containers and to reduce the volume of the containers.

2. Description of the Related Art

Over the years, many crushing devices have been developed whose primary purpose have been to flatten and reduce for scrap tin cans and beverage containers. The inventor is aware of a number of these devices. However, the devices know to him have been rather complex, complicated devices and obviously expensive to construct. For example, Cassell, U.S. Pat. No. 1,598,364; Bruton, U.S. Pat. No. 1,766,327; and Mickler, U.S. Pat. No. 4,195,562 show crushing and can mangling devices using rather complicated machinery to shred and crush cans, especially the devices of the latter two patents, which obviously require very high strength precision-made teeth, all adding to the expense of the device and rendering the device potentially in need of frequent repairs. Other devices present extensive apparatus for crushing containers, such as shown in the patent to Pagdin, U.S. Pat. No. 3,749,004, wherein a plurality of pairs of opposing crushing rollers ranged in series receive the cans, the first to pierce and the second to crush. While the above devices do accomplish the job of crushing beverage containers and puncturing the beverage container if filled with liquid, yet the machines suffer from infirmities of cost of construction or reliability.

Accordingly, it would be useful to have a device adapted to crush beverage containers, and especially those containers which still have the liquid sealed within them, wherein means are provided at an economical cost to relieve the containers of their liquid and then to crush the containers in order to reduce the containers to scrap and reduce their volume. In addition, it would be useful to provide means to collect the liquid formerly interiorly to the containers. All should be done with a device which is reliable, which may be easily operated and constructed, and is economical in cost.

SUMMARY OF THE INVENTION

This invention relates to easily and economically constructed beverage container crusher which provides for acceptance of a relatively large number of beverage containers, usually having a liquid sealed therein, the device passing the containers into a pair of counter rotating crushing drums, the drums providing means to firstly pierce or puncture the beverage container to permit release of the liquid as the container is being crushed and secondly to crush the containers, and then dropping the crushed cans into a stretched metal mesh basket which collects the containers while allowing the released liquid to run off and be collected in a sump pan for draining away.

More specifically, the subject beverage container crusher, the device is built around four vertical angle iron standards having at the top, bottom, and middle, connecting four-sided channel steel horizontal structural members, the top horizontal structural members receiving a portable load hopper containing a plurality of beverage containers to be crushed, preferably hoisted into place with a forklift truck, the portable load hopper feeding into a upper feed upper whereby the weight of the beverage containers open a flop gate allowing the beverage containers to be directed into counter rotating crusher drums through a narrowing lower feed hopper.

The crusher drums are characterized as two counter rotating synchronized motor driven rollers, having welded on their cylindrical surface elongated right angle steel members forming a plurality of rows which comprise the primary crusher teeth, the primary crushing teeth of one crushing drum intermeshing with the primary crushing teeth of the other drum. By such means, as the beverage container passes through the counter rotating drums it is bent and crushed. When viewed on end, the right angle irons or steel members welded to the steel rollers appear to be rows of elongated pyramidal shaped teeth.

However, in order to reduce the amount of power necessary to rotate the drums and crush the containers, especially when the containers have a liquid sealed internally thereto, means are provided located upon the primary crushing teeth to firstly pierce or puncture the beverage containers to permit relieving of the internal pressure and allowing the liquid to escape. These secondary piercing teeth are mounted on the sides of the primary crushing teeth at staggered locations, the secondary piercing teeth comprising pyramidal shaped teeth having a rectangular cross section and welded to the sides of the primary crushing teeth.

The beverage container, once entering between the counter rotating and synchronized crushing drums, may be firstly engaged by either the secondary piercing teeth or primary crushing teeth depending on the specific orientation of the beverage container. However, if it is first seized by the primary crushing teeth, before substantial crushing of the beverage container has begun, the secondary piercing teeth have begun to puncture the beverage container in at least one place, and most often in a plurality of places, to permit the liquid to drain from the container as it is being crushed by the primary crushing teeth. The crushing drums are situated within an upper containment hopper which directs the liquid downward along with the crushed containers.

The crushed containers drop from the crushing drums and are received in a basket lined on 5 of 6 sides by expanded metal mesh which permits the liquid to escape from the basket into a lower sump pan which at its lowest most point, has an opening which permits draining of the liquid away from the machine. The portable discharge basket which receives the crushed containers is adaptable to being picked up by a forklift truck and taken away from the device.

It is an object of the subject invention to provide a beverage container crushing machine which receives a plurality of beverage containers, filled with liquid, and firstly pierces the containers to permit the contained liquid to drain from the container as the container is being crushed.

It is another object of the subject invention to provide crushing drums having a plurality of rows of primary crushing teeth adapted to seize the beverage container and crush it between them.

It is still another object of the subject invention to provide a pair of counter rotating, synchronized crushing drums wherein secondary piercing teeth are provided on the sides of the primary crushing teeth in order that the beverage container first be punctured before it is crushed in order to allow contained liquids to escape.

Other objects of the invention will in part be obvious and will in part appear hereinafter. The invention accordingly comprises the apparatus comprising the construction, combination of elements, and arrangement of parts which are exemplified in the following detailed disclosure and the scope of the invention which will be indicated in the claims.

BRIEF DESCRIPTION OF THE DRAWINGS

For further understanding of the nature and objects of the subject invention, reference should be had to the following detailed description taken in conjunction with the accompanying drawings wherein.

In various views, like index numbers refer to like elements.

DETAILED DESCRIPTION OF THE PREFERRED EMBODIMENT

Figure 1:
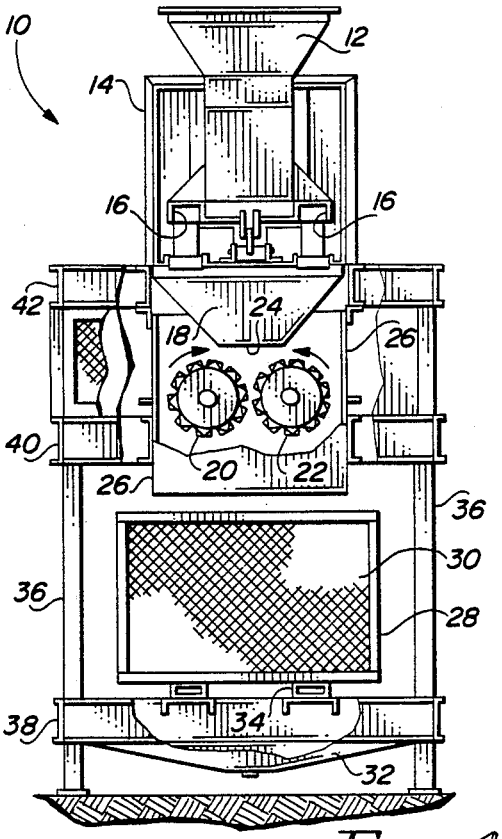
FIG. 1 is a front elevational view of the subject beverage container crusher.

Referring now to FIG. 1, a front elevational view of the subject invention is shown wherein there have been partial cutaways to reveal pertinent parts of container crusher 10 adapted to crush beverage containers while still sealed containing liquids. Commencing at the top, the portable load hopper 12, which is removable, contains a large number of the beverage cans or other materials to be crushed is inserted into an open box-like structure, namely upper feed hopper 14. At the rear of portable load hopper 12 is a flop gate which allows beverage containers held in the hopper to exit the hopper by gravity and enter the crusher to be crushed. Portable load hopper 12 is most easily transported by means of a forklift truck with its fork entering elongated cavities 16 for removal from container crusher 10 and filling with a new load of beverage containers. Upper feed hopper 14 is attached to horizontal channel steel four sided support 42 which also provides a rest for portable load hopper 12. Immediately below upper feed hopper 14 and receiving containers from it is lower feed hopper 18 which directs the containers to the crusher drums 20 and 22 situated immediately below the outlet of lower feed hopper 18. Lower feed hopper 18 is pyramidal frustum shaped with a rectangular lower opening to drop containers onto crusher drums 20 and 22 for piercing and crushing to flatten. Lower feed hopper outlet 24 is centrally located between crusher drums 20 and 22 and within the area defined by the center points of each of the cylindrical crusher drums 20 and 22 in order that beverage containers will not have a tendency to move in a direction other than to the area between the two drums. In addition, the drums are counter rotating with respect to each other, both rotating toward each other (as viewed from the top) so as to pull beverage cans down between them. Directional arrows showing direction of rotation are shown in FIG. 1 proximate each of the drums.

It is noted that both drums 20 and 22 reside interiorly to a rectangular shaped enclosure 26 which confines the beverage containers in order that they will have to pass between the crusher drums. This drum enclosure then extends substantially below the two crusher drums and terminates just above portable discharge basket 28 which receives the crushed container cans and liquid which formerly was in the containers.

Figure 3:
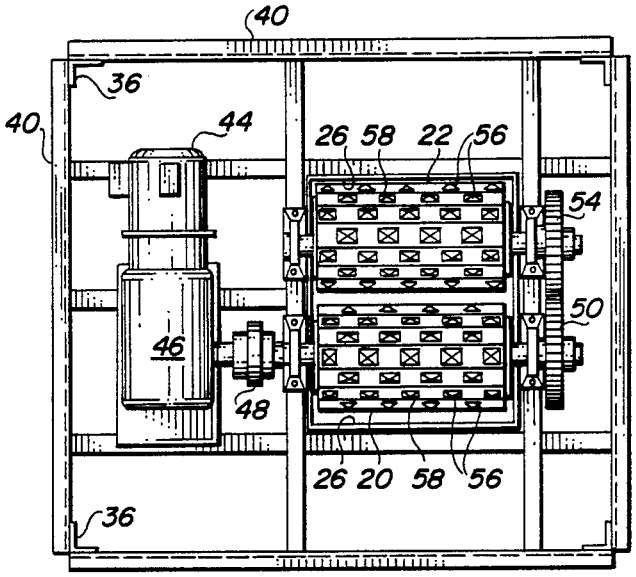
FIG. 3 is a cutaway view taken immediately above the crushing drums showing the orientation of the crushing drums and the motor assembly and gearing driving the counter rotating synchronized crushing drums.
Figure 2:
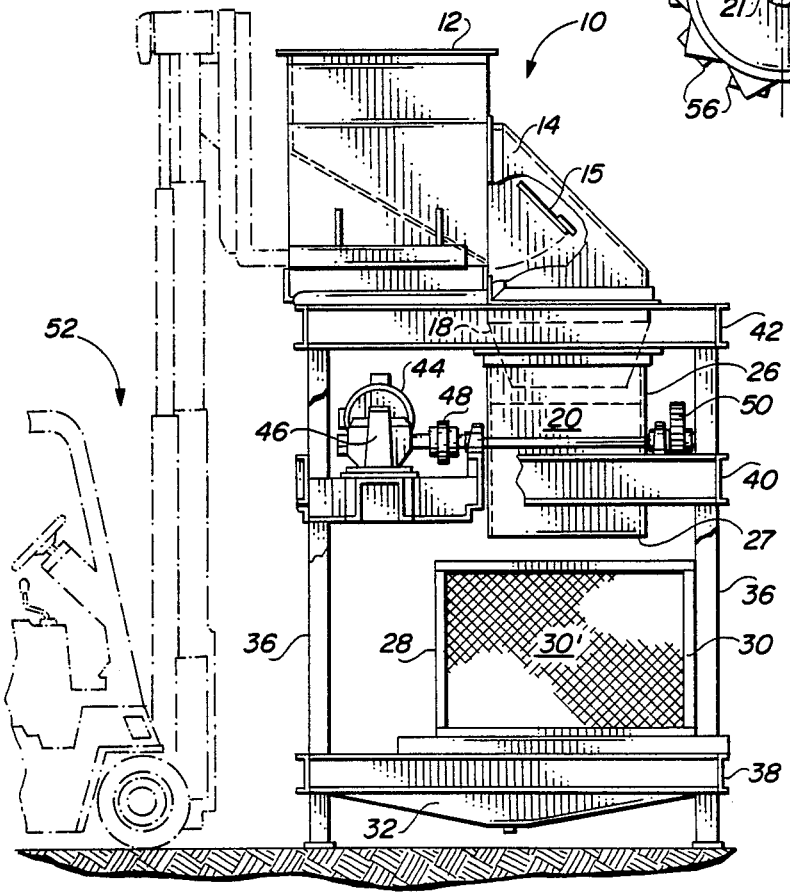
FIG. 2 is a side elevational view of the subject beverage container crusher.

Surrounding the area containing the crusher drums 20 and 22, as well as their driving motors (FIGS. 2 and 3), is protective steel mesh 43. Steel mesh 43 is attached to upper horizontal channel steel support 42 and to mid horizontal channel steel four sided support 40, which also supports crusher drums 20 and 22, as well as the motor assembly (FIGS. 2 and 3).

Inasmuch as it's not desired to keep the liquid with the crushd containers, basket 28 is constructed from expanded metal sheet (wire mesh) 30 on its sides and bottom to permit the draining of the liquid. Basket 28 is supported upon bottom horizontal channel steel four sided support 38. At the bottom and directly beneath basket 28 is drain sump pan 32 which is concave in shape to receive the liquid formerly contained in the beverage containers. In the very bottom of pan 32 is an outlet which permits connection to a hose for draining the liquid away. Pan 32 is also attached to bottom support 38.

As seen in FIG. 1, portable discharge basket 28 has a pair of elongated rectangular shaped metal tubes 34 which accommodate the forks of a forklift truck in order to provide for the removal of the crushed beverage containers.

As can be seen in FIG. 1, the subject beverage container crusher 10 is constructed from four parallel right angle steel standards 36 with horizontal channel beams 38 (at the bottom), 40 (at the midsection), and 42 (at the top), the "channel" beams welded to each of the four standards to provide a stable frame and to provide means to attach the various elements of the invention.

FIG. 2 is a side elevational view of the subject beverage container crusher 10. Here again, like the description of FIG. 1, starting at the top, portable load hopper 12 is show being placed interiorly to upper feed hopper 14 (the side of which has been removed to view the portable load hopper 12) detailing the flop gate 15 attached to load hopper 12 which swings outward to permit beverage containers interiorly to portable load hopper 12 to slide out of portable load hopper 12 and down the chute portion at the rear of upper feed hopper 14. The beverage containers then flow by gravity through the lower feed hopper 18 into the immediate vicinity of the crusher drums 20 and 22. Lower feed hopper 18 has a rectangularly shaped narrowing opening 24. Surrounding the lower portion of the lower feed hopper 18 and crusher drum 20 is the rectangular shaped upper containment enclosure 26. The beverage containers exit upper containment enclosure 26 at its lower mouth 27 into portable discharge basket 28. As mentioned previously, portable discharge basket 28 is surrounded on 5 of its 6 sides by expanded metal sheet 30. The liquid is collected then in drain sump pan 32.

Additionally shown in FIG. 2 is the motor assembly consisting of motor 44 attached to speed reducer 46. Emanating from speed reducer 46 is the shaft connecting to flexible coupler 48 which then leads in through the journal bearings and to crusher drum 20. On the opposite side of crusher drum 20 is another journal bearings and gear 50 which, as will be detailed in FIG. 3, meshes with a similar gear attached to the shaft connecting crusher drum 22 in order that the crusher drums rotate synchronously.

Shown in FIG. 2 is forklift truck 52 by which means the portable load hopper 12 is inserted into the upper feed hopper 14 for loading the full beverage containers into the beverage container crusher 10, as well as providing the means to remove portable discharge basket 28 of pierced and crushed beverage containers.

As was similarly described in FIG. 1, the four vertical standards 36 are shown which provides structural integrity to the device, connective to the lower horizontal channel beam support 38, mid horizontal channel beam support 40, and top horizontal channel beam support 42.

FIG. 3 details a sectional view taken below the lower feed hopper outlet 24 and above the crusher drums 20 and 22 but, also encompassing those portions of the motor 44 and speed reducer 46 above that sectional line. In FIG. 3, the surrounding mid-horizontal channel beam support 40 is shown providing the horizontal structural integrity to the machinery attached to it. Vertical standards right angle steel 36 are shown in each corner of the joinder of these horizontal channel beams. Situated in the left hand side of the figure is the motor assembly, i.e., motor 44 with its attached speed reducer 46, both resting upon cross bars joining opposite sides of the horizontal channel beam support 40. Exiting from speed reducer 46 is its shaft attached to flexible coupler 48, the other side of flexible coupler 48 then passing into the shaft centrally attached to elongated cylindrical crusher drum 20. The central shaft or axle for crusher drum 20 is journaled on both sides by bearings resting upon cross bars also ultimately attaching to the horizontal channel beam support 40. On the end of the central shaft of crusher drum 20 opposite flexible coupler 48 is gear 50, gear 50 being the drive means for crusher drum 22 through gear 54 attached to the central shaft of crusher drum 22.

Intermeshing gears 50 and 54 are the same size and have the same number of teeth in order that drum 22 run synchronously to drum 20, i.e., that the crushing and piercing teeth of drum 20 always have the same rotational relationship to the crushing and piercing teeth of drum 22. Surrounding both crusher drums 20 and 22 and running from the top horizontal channel beam support 42 (not shown) to below horizontal channel beam 40 is the upper containment enclosure 26. It is noted that openings will need be formed in opposite sides of upper containment enclosure 26 in order to pass the central shafts of each of the crusher drums. Immediately outside of the upper containment enclosure 26 resides the bearings which support the crusher drums central axle. Obviously, the openings formed on the sides of upper containment enclosure 26 through which the central shafts of crusher drums 20 and 22 pass are a source of possible leak of liquid as the beverage cans are pierced and crushed. While leakage through these openings has not been excessive, if desired, "O" rings with a circular peripheral slot receiving the metal sides of upper containment enclosure 26 may be utilized to seal these openings.

Figure 4:
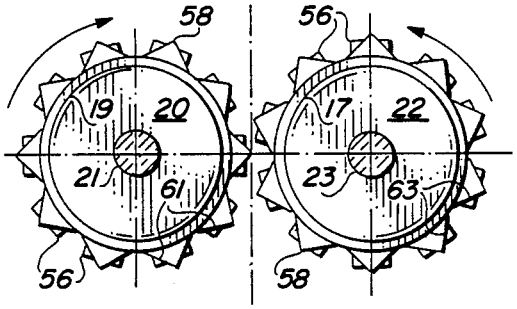
FIG. 4 is a cross sectional view taken of the counter rotating crusher drums showing the pyramidal shaped primary crushing teeth and the pyramidal shaped secondary piercing teeth adapted to receive, pierce, and crush the beverage container.

Seen on the surfaces of the elongated pointed primary crushing teeth 58 of crusher drums 20 and 22 are secondary beverage can piercing teeth 56. These teeth, which are placed upon the elongated sides of primary crushing teeth 58, which are arranged in longitudinal rows, are also illustrated in FIG. 4. Secondary piercing teeth are pyramidal shaped teeth, four triangularly sided, with their rectangular base attached by welding to the sides of primary crushing teeth 58. As shown in FIG. 3, secondary piercing teeth 56 are scattered upon the sides of primary crushing teeth 58 in a pattern such that the teeth are staggered or interlaced from one primary crushing tooth to the next primary crushing tooth and from one side of a tooth to the other. By this means, assurance is obtained that the beverage container will not slip between the crushing drums such that it is not first pierced to release the contained liquid before it is crushed. Without the primary piercing teeth, undue load would be placed upon the crushing drums 20 and 22 and motor assembly since they would be required to crush each of the beverage container cans with contained liquid in each case the container would have to be crushed sufficiently that the liquid inside would cause the container to rupture for the liquid to escape. With the secondary piercing teeth 56, the can is pierced immediately or almost immediately upon being engaged by the primary crushing teeth so that the can is pierced and the liquid is allowed to drain as the container is being crushed, thus reducing substantially the power requirements of the crusher drums.

FIG. 4 is a cross sectional view taken of the counter rotating crusher drums 20 and 22 detailing the positional relationships of the primary crushing teeth 58 on each of the two crusher drums relative to each other, i.e., that the crusher drums are so oriented one to another by means of gears 50 and 54 (FIG. 3) such that when the apex of one of the primary crushing teeth 58 on crusher drum 20 is at its closest point to crusher drum 22, it falls in the groove between two primary crushing teeth 58 on crusher drum 22. Further, as seen in FIG. 4, nor does the point of primary crushing teeth 58 touch the nearby secondary piercing teeth 56 located on crusher drum 22. Shown in FIG. 4 are the secondary piercing teeth 56 which are located on and securely fastened to, such as by welding, opposite sides of the primary crushing teeth 58. As can be seen by the illustration in FIG. 4, the primary crushing teeth of both crusher drums 20 and 22 mesh in their rotational relationship, however, they do not touch. Thus it is apparent that as the beverage container is pulled down through the space between crushing drums 20 and 22, may opportunities are presented for the piercing teeth 56 to rupture the can or container before the container is crushed by crushing teeth 58 in order that the liquid will leave the beverage container through one of the openings created by the piercing teeth before the can would otherwise rupture at some unknown point by being crushed.

In the preferred embodiment of the invention, the crushing drums 20 and 22 were constructed of rather large, elongated cylinders (10 inch steel pipe) approximately 24 inches long. To secure the pipe equally spaced from the central axles or shafts 21 and 23, annular rings were cut from sheet steel which has an inner diameter close to the diameter of shafts 21 and 23 and an outer diameter close to the inner diameter of the steel pipes 19 and 17. These steel rings were located at opposite ends of each of the crusher drums and welded to the exterior steel pipe 19 and 17, and to the central shafts 21 and 23. To form the primary crushing teeth 58, 2 foot long 90 degree angle iron were laid along the exterior peripheral surface of steel pipes 17 and 19 in the pipe longitudinal directions and then welded in place to form rows having triangular cross-section. Numeral 61 and 63 refer to the right angle irons located on the outside peripheral surface of steel pipes 19 and 17 respectively.

As previously mentioned, secondary piercing teeth 56 are pyramidal shaped, constructed of hardened steel, and having a rectangular cross section, and are attached by welding at various places along the sides of each of the primary crushing teeth. A pattern has been suggested for locating the piercing teeth 56 along each of the sides of the primary crushing teeth 58 such as shown in FIG. 3 where on one side of one primary crushing teeth, the piercing teeth would be evenly spaced, and then on the other side of the primary crushing teeth a pattern where the teeth are also evenly spaced but interlaced with the teeth on the first side of the primary crushing teeth. The pattern then is repeated for each of the right angle irons welded to the steel pipes in order that each beverage can will be punctured at least once by a piercing tooth before it passes through the narrowest portion between the two crushing drums.

In the preferred embodiment, the piercing and crushing apparatus was so constructed that the crushing drums rotated at a speed of about 9 revolutions per minute. Since the drums are synchronized one with another through their gearing system, both drums counter rotate at the same rate. The speed reducer reduces the motor's speed to the desired crushing drum rotation rate.

The crushed and mangled beverage containers are collected in the portable discharge basket 28 and when viewed, generally take the shape of a flattened can, however, usually bent at some portion in the length of the can to form somewhat of an "L". The points at which the cans are initially pierced by the piercing teeth from which the contained liquid escaped are readily evident by viewing the cans.

While a preferred embodiment of the subject invention has been shown and described, it will be understood that there is no intent to limit the invention by such disclosure, but rather it is intended to cover all modifications and alternate constructions falling within the spirit and the scope of the invention as defined in the appended claims.

I claim:

1. A beverage container crusher adapted to crush beverage containers holding liquids, the beverage container crusher comprising:

an upper feed hopper to receive beverage containers;

a pair of crushing drums receiving the beverage containers from said upper feed hopper, said crushing drums defining elongated rotating cylinders;

a plurality of primary crushing teeth having a triangular cross section attached to said elongated rotating cylinders in longitudinal rows, said primary crushing teeth engaging the beverage containers for crushing;

a plurality of secondary piercing teeth attached to said primary crushing teeth, said piercing teeth defining pyramidal shaped teeth having four triangular sides and a rectangular base, said piercing teeth adapted to pierce the beverage containers as the beverage containers are engaged by the primary crushing teeth to permit draining of the contained liquid while the beverage containers are being crushed;

a wire mesh basket situated below said crushing drums, said wire mesh basket receiving the crushed beverage containers and liquid to hold the crushed beverage containers; and a sump pan situated below said wire mesh basket, said sump pan receiving the liquid which was formerly held in the beverage containers, said sump pan adapted to permit draining away of the liquid.

2. The beverage container crusher as defined in claim 1 wherein said pair of crushing drums are proximate each other, counter rotating, and are synchronized with respect to each cylinder's rotation.

3. The beverage container crusher as defined in claim 2 wherein said pair of crushing drums are driven by an operably attached motor assembly, said motor assembly including a drive motor, speed reducer, and flexible coupling.

4. The beverage container crusher as defined in claim 3 wherein said primary crushing teeth arranged in longitudinal rows comprise one elongated pointed tooth for each row.

5. The beverage container crusher as defined in claim 4 wherein said primary crushing teeth define two elongated sides rising up from said elongated rotating cylinders to a point, and said secondary piercing teeth are spaced apart on each side of said primary crushing teeth.

6. The beverage container crusher as defined in claim 5 wherein said secondary piercing teeth arranged on each side of said primary crushing teeth are interlaced so as not to be directly opposite each other.

7. The beverage container crusher as defined in claim 6 further including a pair of intermeshing gears, one of each of said gears attached to one of each of said crushing drums, said gears adapted to permit one crushing drum to drive the other crushing drum, and to synchronize and to maintain the crushing drums in rotational synchronization.

8. The beverage container crusher as defined in claim 7 further including a portable feed hopper, said portable feed hopper received into said upper feed hopper, said portable feed hopper adapted to convey beverage containers to the upper feed hopper for crushing.

9. The beverage container crusher as defined in claim 8 wherein said wire mesh basket includes fitting means by which said basket may be removed by an associated fork lift truck.

* * * * *